United States Patent [19]

Altland et al.

[11] 4,378,424

[45] Mar. 29, 1983

[54] MESOIONIC 1,2,4-TRIAZOLIUM-3-THIOLATES AS SILVER HALIDE STABILIZERS AND FIXING AGENTS

[75] Inventors: Henry W. Altland; Edward L. Dedio; Gary J. McSweeney, all of Rochester, N.Y.

[73] Assignee: Eastman Kodak Company, Rochester, N.Y.

[21] Appl. No.: 324,491

[22] Filed: Nov. 24, 1981

Related U.S. Application Data

[63] Continuation-in-part of Ser. No. 215,786, Dec. 12, 1980, abandoned.

[51] Int. Cl.[3] ..... G03C 5/38; G03C 1/06

[52] U.S. Cl. ..... 430/352; 430/354; 430/455; 430/566; 430/955

[58] Field of Search ..... 430/203, 234, 248, 251, 430/254, 352, 353, 354, 355, 419, 428, 429, 456, 455, 566, 611, 613, 617, 955, 618, 619, 620, 957, 960

[56] References Cited

U.S. PATENT DOCUMENTS 3,017,270 1/1962 Tregillus et al. ..... 430/248
3,252,799 5/1966 Götze et al. ..... 96/109
3,893,859 7/1975 Burness et al. ..... 96/61
4,003,910 1/1977 Bartels-Keith et al. ..... 260/308
4,012,260 3/1977 Dickerson et al. ..... 96/114.1

OTHER PUBLICATIONS

Research Disclosure, Dec. 1978, Item No. 17643.
Research Disclosure, Jun. 1978, Item No. 17029.
Research Disclosure, Jan. 1979, Item No. 17710.
J. C. S. Perkin I., p. 633–638, 1974, by W. David Ollis et al.
Journal of Organic Chemistry, 37 (7), p. 2245–2252 (1967).
Chemical Abstracts, 63:2966b (1965).
Research Disclosure, Apr. 1981, Item No. 20430.

*Primary Examiner*—Mary F. Downey
*Attorney, Agent, or Firm*—Richard E. Knapp

[57] ABSTRACT

Mesoionic 1,2,4-triazolium-3-thiolates are silver halide stabilizers and fixing agents. They are useful in heat developable and heat stabilizable photographic silver halide materials and processes. After imagewise exposure of the photographic materials, developed and stabilized silver images are produced by heating the materials. The mesoionic 1,2,4-triazolium-3-thiolates are also silver halide stabilizers and fixing agents in photographic silver halide processing compositions.

17 Claims, No Drawings

MESOIONIC 1,2,4-TRIAZOLIUM-3-THIOLATES AS SILVER HALIDE STABILIZERS AND FIXING AGENTS

This is a continuation-in-part patent application of Ser. No. 215,786 of H. W. Atland et al, filed Dec. 12, 1980 now abandoned.

BACKGROUND OF THE INVENTION

1. Field of the Invention

This invention relates to use of mesoionic 1,2,4-triazolium-3-thiolates as silver halide stabilizers and fixing agents. Such compounds are useful in stabilizing and fixing a developed image in a heat developable and heat stabilizable photographic silver halide material and process. It also relates to use of such stabilizers and fixing agents in photographic silver halide processing compositions.

2. Description of the State of the Art

Mesoionic sulfur containing tetrazole compounds have been described in the photographic art as photographic additives to improve image tone and density in, for instance, U.S. Pat. No. 4,003,910. However, the prior art does not suggest that these compounds would be useful in a heat developable and heat stabilizable photographic material and process, nor as silver halide stabilizers and fixing agents.

The use of stabilizers and stabilizer percursors in heat developable and heat stabilizable photographic materials and processes is known. Examples of known stabilizers and stabilizer precursors are described in, for instance, U.S. Pat. No. 4,012,260. An example of a heterocyclic stabilizer precursor is 2-amino-2-thiazolinium trichloroacetate.

A continuing need has existed for water-soluble, organic stabilizers and fixing agents for photographic silver halide that provide light-insensitive silver (I) complexes upon exposure and processing of a photographic silver halide material, such as a heat developable and heat stabilizable material comprising a silver halide stabilizer. Such light-insensitive silver (I) complexes help provide light stability to a developed image in a processed photographic silver halide element.

The term "material", as used herein, such as in photographic silver halide material, refers to photographic elements and photographic compositions. For instance, the term "heat developable and heat stabilizable photographic silver halide material" refers to photographic elements and photographic compositions.

SUMMARY OF THE INVENTION

According to the invention, a developed and stabilized silver image is provided in a heat developable and heat stabilizable photographic silver halide material. This material according to the invention comprises, in reactive association, in binder:

(a) photographic silver halide, preferably as a photographic silver halide gelatino emulsion;

(b) a photographic silver halide developing agent;

(c) an activating concentration of a thermal base releasing compound; and (d) a stabilizing concentration of a heterocyclic sulfur containing silver halide stabilizer.

The heterocyclic sulfur containing silver halide stabilizer according to the invention comprises a mesoionic 1,2,4-triazolium-3-thiolate silver halide stabilizer. The silver halide stabilizer provides a stabilized silver image upon processing of an exposed photographic silver halide material.

The stabilizer according to the invention is also useful in heat activatable photographic silver halide processing compositions comprising a photographic silver halide developing agent, a thermal base releasing compound and a silver halide stabilizing concentration of the stabilizer according to the invention.

The stabilizer according to the invention is also useful in a photographic silver halide fixing composition comprising a silver halide fixing concentration of a mesoionic 1,2,4-triazolium-3-thiolate and an organic acid, such as acetic acid. The fixing composition enables fixing of silver halide from an exposed and developed photographic silver halide element, such as a silver halide photothermographic element comprising a hydrophobic binder.

DETAILED DESCRIPTION OF THE INVENTION

Many mesoionic 1,2,4-triazolium-3-thiolates are useful silver halide stabilizers and fixing agents according to the invention. Combinations of such stabilizers and fixing agents are also useful. Selection of an optimum stabilizer or combination of stabilizers will depend upon such factors as the desired image stability, processing conditions, the particular silver halide in the photographic material, the particular silver halide developing agent and other addenda in the photographic material. Examples of useful mesoionic 1,2,4-triazolium-3-thiolates are represented by the formula:

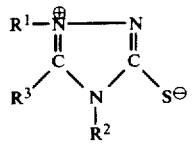

wherein $R^1$ is alkyl containing 1 to 18 carbon atoms, such as methyl, ethyl, propyl, butyl, decyl and octadecyl; aryl containing 6 to 20 carbon atoms, such as phenyl, 4-tolyl and α-naphthyl; or cycloalkyl containing 3 to 12 carbon atoms, such as cyclohexyl and cyclopentyl;

$R^2$ is amino, including

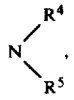

alkenyl containing 3 to 18 carbon atoms, such as allyl and 2-butenyl; alkyl containing 1 to 18 carbon atoms, such as methyl, ethyl, propyl, butyl and pentyl; aryl containing 6 to 20 carbon atoms, such as phenyl and α-naphthyl; cycloalkyl containing 3 to 12 carbon atoms, such as cyclohexyl and cyclopentyl; alkoxyalkyl containing 2 to 18 carbon atoms, such as 2-methoxyethyl, 3-methoxypropyl, and 4-methoxybutyl; and $R^3$ is alkyl containing 1 to 9 carbon atoms, such as methyl, ethyl, propyl, butyl and pentyl; or aryl containing 6 to 12 carbon atoms, such as phenyl and α-naphthyl;

$R^4$ and $R^5$ are individually hydrogen, alkyl containing 1 to 18 carbon atoms, such as methyl, ethyl, propyl and decyl, or aryl containing 6 to 20 carbon atoms, such as phenyl, tolyl and naphthyl, provided that when one of $R^4$ and $R^5$ is alkyl then both $R^4$ and $R^5$ are alkyl.

The term "alkyl" herein means unsubstituted alkyl and alkyl substituted by means of a group which does not adversely affect the desired sensitometric properties of the photographic silver halide and does not adversely affect the desired stabilizing properties of the stabilizer according to the invention. Examples of suitable substituents on the alkyl include methoxyl and $\alpha,\alpha$-dimethoxymethyl.

The term "aryl" herein means unsubstituted aryl and aryl substituted by means of a group which does not adversely affect the desired sensitometric properties of the photographic silver halide and does not adversely affect the stabilizing properties of the stabilizer according to the invention. Examples of suitable substituents on the aryl include methyl and methoxy.

An especially useful 1,2,4-triazolium-3-thiolate is 1,4,5-trimethyl-1,2,4-triazolium-3-thiolate (Compound A) represented by the formula:

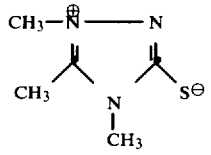

Examples of other useful 1,2,4-triazolium-3-thiolates include:

1,5-dimethyl-4-(2-methoxyethyl)-1,2,4-triazolium-3-thiolate (Compound B) represented by the formula:

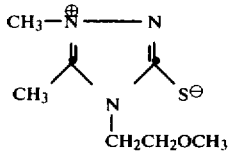

1,5-dimethyl-4-amino-1,2,4-triazolium-3-thiolate (Compound C) represented by the formula:

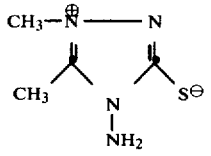

1,5-dimethyl-4-allyl-1,2,4-triazolium-3-thiolate (Compound D) represented by the formula:

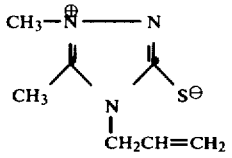

1-methyl-4-(2-methoxyethyl)-5-phenyl-1,2,4-triazolium-3-thiolate (Compound E) represented by the formula:

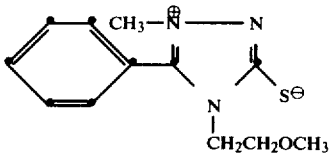

1,5-dimethyl-4-isopropyl-1,2,4-triazolium-3-thiolate (Compound F) represented by the formula:

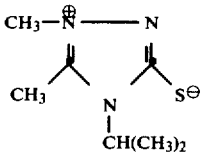

1-methyl-4,5-diphenyl-1,2,4-triazolium-3-thiolate (Compound G) represented by the formula:

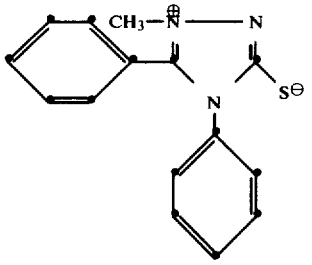

1,5-dimethyl-4-phenyl-1,2,4-triazolium-3-thiolate (Compound H) represented by the formula:

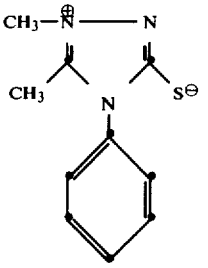

1,5-dimethyl-4-ethyl-1,2,4-triazolium-3-thiolate (Compound I) represented by the formula:

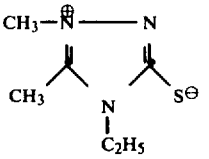

1,5-dimethyl-4-(2,2-dimethoxyethyl)-1,2,4-triazolium-3-thiolate (Compound J) represented by the formula:

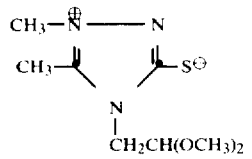

The 1,2,4-triazolium-3-thiolates are prepared by methods known in the organic chemical synthesis art. The preparation of 1,4,5-trimethyl-1,2,4-triazolium-3-thiolate illustrates preparation of a 1,2,4-triazolium-3-thiolate:

Acetic anhydride (10.2 g, 0.1 mol) was slowly added to a stirred distilled water (11 g) solution of methyl hydrazine (4.6 g, 0.1 mol) at ice-bath temperature. The resulting solution was stirred at room temperature for one hour and the water was removed under reduced pressure. The residual oily acethydrazide was suspended in ethyl ether and to this stirred mixture at room temperature was slowly added an ether (25 ml) solution of methyl isothiocyanate (7.3 g, 0.1 mol). The resulting stirred solution was kept at room temperature for 30 minutes and then the solvent was removed under reduced pressure. The residual colorless solid was triturated with ethyl ether to give 4.9 g (30 percent) of the thiosemicarbazide (a white powder); m.p., 180° and 181° C. (lit. m.p. 175° to 177° C.). The thiosemicarbazide (5.0 g, 0.03 mol) was refluxed in a methanol (25 ml) solution for 21 hours. During this reflux period, the thiosemicarbazide completely dissolved in the refluxing methanol and the triazolium thiolate, a colorless solid, then separated (m.p., 258° to 259° C.) (m.p. reported in literature, 256° to 257° C.).

Another illustrative method of preparation is the preparation of 1,5-dimethyl-4-(2-methoxyethyl)-1,2,4-triazolium-3-thiolate as follows: Crude acethydrazide $CH_3N(COCH_3)NH_2$, prepared from acetic anhydride (10.2 g, 0.1 mol) and methylhydrazine (4.6 g, 0.1 mol), as described above, was dissolved in ethyl ether (25 ml) and to the resulting stirred translucent solution at room temperature was slowly added an ether (25 ml) solution of 2-methoxyethyl isothiocyanate (11.7 g, 0.1 mol). After keeping the stirred solution at ambient temperature for one hour, the ether was removed under reduced pressure. More ethyl ether was added to the residual pale yellow syrup, and the resulting colorless solid was stirred at ambient temperature for 18 hours.

The thiosemicarbazide (2.4 g, 0.012 mol) was heated to its melting point (123° C.) for five hours. After cooling to ambient temperature, the crystalline residue was crystallized from ethyl acetate-ethanol to give 1.3 g (59 percent) of pale yellow plates; m.p., 125° to 126° C.; mass spectrum $M^+$ 187.

The structure of the desired product was confirmed by mass spectral analysis and nuclear magnetic resonance.

An illustration of an alternate method of preparation is the synthesis of 1,5-dimethyl-4-(2-methoxyethyl)-1,2,4-triazolium-3-thiolate as follows:

A stirred dichloromethane (40 ml) mixture of 2-methoxyethyl isocyanide dichloride (1.9 g, 0.012 mol) and $CH_3$-CS-$N(CH_3)NH_2$ (1.3 g, 0.012 mol) was refluxed for two hours. Solvent was then removed under reduced pressure and the residual orange semi-solid was dissolved in 50 ml of methanol. One-half of this solution was evaporated to dryness and was then dissolved in methylene chloride (50 ml). Ammonia gas was bubbled through this stirred solution at ambient temperature for about 5 minutes. The resulting precipitate (presumably ammonium chloride) was collected, and the filtrate was evaporated to dryness to yield a reddish-brown semi-solid. A stirred ethanol (50 ml) solution of this solid was refluxed for 18 hours. Solvent was removed under reduced pressure to give a slowly crystallizing orange oil. An ethyl acetate solution of this material was treated with decolorizing carbon and eluted through Celite. The ethyl acetate eluate was concentrated to about 25 ml, and colorless plates began to separate. The desired compound was formed having a melting point of 123° to 125° C.

The desired products are purified by procedures known in the chemical art, such as by recrystallization.

One embodiment of the invention is a heat developable and heat stabilizable photographic silver halide element comprising a support having thereon, in reactive association, in binder: (a) photographic silver halide, preferably as a photographic silver halide gelatino emulsion, (b) a photographic silver halide developing agent, (c) an activating concentration of a thermal base releasing compound, and (d) a stabilizing concentration of a silver halide stabilizer comprising a mesoionic 1,2,4-triazolium-3-thiolate stabilizer according to the invention.

The photographic material according to the invention comprises photographic silver halide. Useful photographic silver halides include, for example, silver chloride, silver bromide, silver bromoiodide, silver chlorobromoiodide and mixtures thereof. The grain size of the silver halide ranges from coarse grain to fine grain. The photographic silver halide is prepared by procedures known in the photographic art, as described in, for example, *Research Disclosure*, December 1978, Item No. 17643, and *Research Disclosure*, June 1978, Item No. 17029. The photographic materials according to the invention, if desired, also contain addenda which do not adversely affect the desired properties of the materials, such as antifoggants, tone modifiers, chemical sensitizers, hardeners, matting agents, brighteners, absorbing and filter dyes, development modifiers, spectral sensitizers and coating aids, as described in these *Research Disclosure* publications.

The heat developable and heat stabilizable photographic materials according to the invention contain binders and vehicles alone and in combination. Suitable vehicle materials include both naturally-occurring substances, such as protein, for example, gelatin, gelatin derivatives, cellulose derivatives, polysaccharides such as dextrin, gum arabic and the like, and synthetic polymeric materials such as water-soluble polyvinyl compounds like poly(vinyl pyrrolidone), acrylamide polymers and the like. The photographic layers and other layers of the elements of the invention such as overcoat layers, interlayers and subbing layers can also contain, alone or in combination with the described vehicles, other synthetic polymeric vehicle compounds, such as dispersed vinyl compounds, such as in latex form, and in particular those which increase the dimensional stability of the photographic materials. Useful binders are also described in the above *Research Disclosure* publications. Selection of an optimum binder depends upon such factors as the processing conditions, the particular components of the photographic material and the desired image.

Many supports are useful for a photographic element according to the invention. Typical supports include those which are resistant to adverse changes in structure and do not adversely affect the sensitometric properties of the described photographic materials at the processing temperatures employed. Typical supports include cellulose ester film, poly(vinyl acetal) film, poly(ethylene terephthalate) film, polycarbonate film and related films and resinous materials, as well as glass, paper, metal and the like. Typically, a flexible support is employed, especially a paper support.

The heat developable and heat stabilizable layer and other layers of a photographic element according to the invention are coated by means of coating procedures known in the photographic art. Such procedures are described in, for example, the above *Research Disclosure* publications.

The stabilizer according to the invention is in a location in the photographic material according to the invention which enables the stabilizer to react with the silver halide in the unexposed areas upon processing to form a stable silver (I) complex. The stabilizer is useful in one or more layers of a photographic element according to the invention. The stabilizer is preferably in the layer containing the silver halide. Alternatively, the stabilizer is in an overcoat layer or in a layer between the support and the layer containing silver halide. It is important that the stabilizer be in a location which enables the desired interaction between the stabilizer and the silver halide in the photographic material according to the invention at the proper time during processing. The term "in reactive association" as used herein means that the stabilizer is in such a location enabling such desired interaction.

Many silver halide developing agents are useful in a photographic silver halide material and process according to the invention. Combinations of silver halide developing agents are useful. Useful silver halide developing agents include those described in, for instance, *Research Disclosure*, June 1978, Item No. 17029. Examples of useful silver halide developing agents are ascorbic acid developing agents, such as ascorbic acid, ascorbic acid ketals and ascorbic acid derivatives; reductone developing agents, such as anhydrodihydropiperidino hexose reductone; 3-pyrazolidone developing agents, such as 4-methyl-4-hydroxymethyl-1-phenyl-3-pyrazolidone and 1-phenyl-3-pyrazolidone; and phenolic developing agents, such as polyhydroxybenzene developing agents, including hydroquinone. A preferred silver halide developing agent is ascorbic acid.

Many thermal base releasing compounds are useful in a heat developable and heat stabilizable photographic material according to the invention. The term "thermal base releasing compound" as used herein means a compound which releases an organic base when heated in a photographic material according to the invention to processing temperature. The base released activates development of the exposed photographic silver halide in the photographic material according to the invention at processing temperature. The "activating concentration" of the base release agent herein means that the concentration of base release agent is sufficient in the photographic material to release a sufficient amount of base upon processing to activate development. The base released also helps stabilization by the stabilizer according to the invention. Examples of useful thermal base releasing compounds are described in *Research Disclosure*, June 1978, Item No. 17029, and include guanidinium trichloroacetate, 1,1-dimethyl-1-(2-hydroxypropyl)amine adipimide, 1-($\beta$-aminoethyl)-2-imidazolidone, trichloroacetate, zinc oxide and urea.

The optimum concentration of each of (a) the photographic silver halide, (b) photographic silver halide developing agent, (c) thermal base release agent, and (d) stabilizer according to the invention will depend upon such factors as the desired image, processing conditions and particular components of the heat developable and heat stabilizable photographic material. In a photographic element according to the invention, useful concentrations are within the following ranges:

(a) photographic silver halide: $2.5\times10^{-3}$ to $1.0\times10^{-1}$ moles, preferably $1.0\times10^{-2}$ to $3.0\times10^{-2}$ moles;
(b) photographic silver halide developing agent: $2.5\times10^{-3}$ to $1.0\times10^{-1}$ moles, preferably $1.0\times10^{-2}$ to $3.0\times10^{-2}$ moles;
(c) thermal base releasing agent: $1.25\times10^{-3}$ to $5.0\times10^{-2}$ moles, preferably $5.0\times10^{-3}$ to $1.5\times10^{-2}$ moles;
(d) stabilizer: $2.5\times10^{-3}$ to $1.0\times10^{-1}$ moles, preferably $1.0\times10^{-2}$ to $3\times10^{-2}$ moles, per square meter of support.

An especially useful heat developable and heat stabilizable photographic material according to the invention comprises, in reactive association, in a gelatino binder:

(a) photographic silver halide gelatino emulsion, such as a photographic silver bromide gelatino emulsion;
(b) a photographic silver halide developing agent, such as a photographic silver bromide developing agent, preferably ascorbic acid;
(c) an activating concentration of a thermal base releasing compound consisting essentially of an ethylenebis(sulfonyl acetic acid) compound; and
(d) a stabilizing concentration of a 1,2,4-triazolium-3-thiolate stabilizer consisting essentially of 1,4,5-trimethyl-1,2,4-triazolium-3-thiolate.

The stabilizers according to the invention are useful in photographic silver halide processing compositions that enable use of the silver halide stabilizing properties of the stabilizers according to the invention. Such photographic silver halide processing compositions include silver halide developers, stabilizing compositions, fixing compositions, hardeners and other processing compositions that enable the stabilizer according to the invention to form a silver (I) complex without adversely affecting desired properties of the processing composition and the photographic silver halide material. An example of a silver halide processing composition comprises a silver halide developing agent, a thermal base release agent and a stabilizing concentration of a stabilizer according to the invention, such as 1,4,5-trimethyl-1,2,4-triazolium-3-thiolate. The processing composition generally comprises a solvent or binder.

A processing composition according to the invention is useful as a layer of a photographic silver halide element, such as a layer contiguous to the layer of the element comprising photographic silver halide. Alternatively, the processing composition is useful in the form of a bath into which an exposed and developed photographic silver halide element is immersed. Other processing methods and processing compositions in which the mesoionic silver halide stabilizers according to the invention are useful are described in, for instance, *Research Disclosure*, December 1978, Item No. 17643, which is expressly incorporated herein by reference.

A useful processing composition according to the invention is a photographic silver halide fixing composition comprising a silver halide fixing concentration of a mesionic 1,2,4-triazolium-3-thiolate. A preferred photographic silver halide fixing composition comprises a fixing solution comprising, in an aqueous solvent, a fixing concentration of a mesoionic 1,2,4-triazolium-3-thiolate and an organic acid, such as acetic acid.

Because the stabilizer according to the invention provides stable silver (I) complexes, no additional silver halide stabilizer is necessary in a photographic material according to the invention. However, added silver halide stabilizers and stabilizer precursors are useful in the photographic silver halide materials according to the invention, if desired. Stabilizers and stabilizer precursors that are useful in a photographic silver halide material according to the invention are described in *Research Disclosure*, June 1978, Item No. 17029. An example of a combination of stabilizers is 1,4,5-trimethyl-1,2,4-triazolium-3-thiolate with 2-amino-2-thiazolinium trichloroacetate.

Exposure of a photographic silver halide material according to the invention is by means of forms of energy to which the silver halide is sensitive. The photographic silver halide material is generally imagewise exposed to light. Alternatively, other forms of energy are useful, such as electron beams, X-rays, gamma rays and alpha particles. Lasers are also useful. Imagewise exposure of the photographic silver halide material is generally sufficient in time and intensity to provide a developable latent image in the photographic silver halide material.

After exposure of a photographic silver halide material according to the invention, an image is developed and stabilized by heating the material to a processing temperature within the range of about 100° C. to about 180° C., such as about 130° C. to about 140° C., until the image is developed and stabilized. An image is generally developed and stabilized by heating the photographic silver halide material to a processing temperature within the range of about 100° C. to about 180° C. for about one to about 60 seconds, such as about 10 to about 30 seconds.

Processing is carried out under ambient conditions of pressure and humidity. Normal atmospheric conditions of pressure and humidity are preferred for processing.

Various means are useful for heating the exposed photographic silver halide material according to the invention. The photographic silver halide material containing the developable image is generally brought into contact with a simple hot plate, iron, rollers, dielectric heating means or microwave heating means.

The following examples are included for a further understanding of the invention.

EXAMPLE 1

Silver Halide Stabilization

Compound A was added to the following composition:

| Component | Concentration per dm$^2$ |
|---|---|
| silver chloride (0.24 micron grain size) (Emulsion A) | 0.1 mmol |
| ethylenebis(sulfonyl acetic acid) (thermal base releasing compound) | 0.05 mmol |
| photographic gelatin | 27.0 mg |
| surfactant (Surfactant 10G, which is a para-isononyl-phenoxypolyglycidol, and is a trademark and available from the Olin Corporation, U.S.A.) | 1 mg |
| Compound A (stabilizer) | 0.1 mmol |

The resulting composition was coated on a subbed poly(ethylene terephthalate) film support at a 4 mil wet coating thickness. The coating was permitted to dry and then the resulting element was heated on a heating block at 180° C. for 30 seconds. Inspection of the coating indicated that the silver halide had been completely dissolved prior to heating. Light exposure of the coating resulted in no print-up, indicating complete silver halide stabilization.

This Example also indicates that it is useful to separate the stabilizer of the invention from the photosensitive silver halide before exposure and development.

EXAMPLE 2

Silver Halide Stabilization

The procedure described in Example 1 was repeated, with the exception that Compound A was replaced by Compound B and Emulsion A was replaced with Emulsion B comprising silver bromoiodide (0.24 micron grain size) (2.5 mole percent iodide). Results similar to Example 1 were observed.

EXAMPLE 3

Silver Halide Stabilization

Compound C was added to the following composition:

| Component | Concentration per dm$^2$ |
|---|---|
| photographic gelatin | 200 mg |
| surfactant (Surfactant 10G) | 10 mg |
| silver bromoiodide (2.5 mole percent iodide) | 0.46 mmol |
| Compound C (stabilizer) | 0.69 mmol |
| water | 10 ml |

The coating composition was coated at a 4 mil wet coating thickness on a subbed poly(ethylene terephthalate) film support. The coating was permitted to dry at about 49° C. (120° F.) The coating was light stable, but remained cloudy.

In an alternate procedure, the clarity of the coating was not improved by increasing the stabilizer level to 2.0 moles of stabilizer per mole of silver in the coating. However, when the silver halide was changed to pure silver bromide, a clear, light-stable film was observed. Upon storage, some cloudiness appeared in the film; but the silver bromide coating remained clearer than the silver bromoiodide coating.

EXAMPLE 4

Silver Halide Stabilization

The procedure described in Example 3 was repeated, with the exception that Compound A replaced Compound C. Similar results to those of Example 3 were observed.

EXAMPLE 5

Fixing Bath

A silver halide fixing solution (Fixing Solution A) was prepared by mixing the following:

Compound A (fixing agent): 10.0 g/liter
Acetic acid (28 percent): 48 ml/liter
Water to one liter A photographic silver bromide gelatino emulsion (0.20 μm grains) was coated at 1 mg of silver per 6.2 $cm^2$ (about 150 mg per square foot). The resulting photographic element was sensitometrically exposed to provide a developable latent image. The exposed photographic element was then developed for 3.0 minutes at 25° C. in the following silver halide developer composition:

Water, about 50° C.: 500 ml
N-methyl-p-aminophenol sulfate (developing agent): 2.0 g
Sodium sulfite (anhydrous): 90.0 g
Hydroquinone (developing agent): 8.0 g
Sodium carbonate (monohydrated): 52.5 g
Potassium bromide (anhydrous): 5.0 g
Water to one liter The developed element was then immersed in a stop bath for 30 seconds at 25° C. having the following composition:

Water: 1.0 liter
28 percent acetic acid: 48.0 ml

The element was then immersed for 90 seconds at 25° C. in Fixing Solution A according to the invention. Then the developed and fixed element was washed in water and permitted to dry in air at 20° C.

The results indicated that the undeveloped silver bromide was dissolved upon treatment in the fixing solution, leaving the $D_{min}$ areas clear. Silver analysis of the element after washing and drying showed about 6.2 mg of silver per square centimeter (about 150 mg/$ft^2$) in the $D_{max}$ areas of the element and no silver remaining in the $D_{min}$ areas.

EXAMPLE 6

Photothermographic Material

A photographic silver chloride element was prepared by coating the following on a first subbed poly(ethylene terephthalate) film support:

| | Concentration (per square foot) |
|---|---|
| Ascorbic acid (developing agent) | 200 mg |
| Methyl urea (base) | 100 mg |
| Malic acid (buffer) | 100 mg |
| Photographic gelatin (binder) | 250 mg |
| Surfactant (Surfactant 10G, a para-isononylphenoxy-polyglycidol, and is a trademark of and available from the Olin Corporation, U.S.A.) | 10 mg |
| Silver chloride (0.20 μm grain size) | 150 mg |
| pH adjusted to 4.5 by KOH | |

A silver halide stabilizing element was prepared by coating the following at a 4.0 mil wet coating thickness on a second subbed poly(ethylene terephthalate) film support:

| | Concentration (per square foot) |
|---|---|
| Compound D (stabilizer) | 1.0 g |
| Methyl urea (base) | 200.0 mg |
| Gelatin (binder) | 250.0 mg |
| Surfactant (Surfactant 10G) | 10.0 mg |

The photographic silver halide element was sensitometrically exposed to light to provide a developable latent image in the element. The exposed photographic silver chloride element and the silver halide stabilizing element were then laminated together in face-to-face contact and heated on a metal block at 140° C. for 10 seconds. A photographic silver image was developed and the $D_{min}$ areas were cleared. The resulting developed and stabilized image had a $D_{max}$ of 0.63 and a $D_{min}$ of 0.06. The processed, laminated elements were taped for one week to a window exposed to ambient conditions of temperature (about 19° C.), humidity, sunlight and white fluorescent light. The developed and stabilized image was then observed. The $D_{min}$ had increased slightly to 0.10. An overall pinkish discoloration was also noted. It was speculated that the pinkish color was due to oxidized developer.

EXAMPLE 7

Fixing of Processed Photothermographic Silver Halide Element

A photothermographic silver halide film was prepared by coating on a poly(ethylene terephthalate) film support a photothermographic silver halide layer comprising, in a poly(vinylbutyral) binder, photographic silver bromoiodide in reactive association with an image-forming combination comprising 2,6-dichloro-4-benzenesulfonamidophenol (reducing agent) and silver behenate (oxidizing agent) as described in, for example, European Patent 11,392 and *Research Disclosure*, Volume 177, January 1979, Item No. 17710. The photothermographic film was imagewise exposed to light in a commercial sensitometer to provide a developable latent image in the film. The latent image was developed by heating the film. The resulting film was then immersed for about 30 seconds in a solution (B) comprising 3 milliliters of water and 47 milliliters of methanol at about 19° C. Then the film was immersed for about 60 seconds in a silver halide fixing solution (A) comprising 1 gram of 1,4,5-trimethyl-1,2,4-triazolium thiolate dissolved in a mixture of 3 milliliters of water and 47 milliliters of methanol. Finally, the film was again immersed for about 30 seconds in solution (B). The film in each solution was agitated by a rocking motion. The film before processing contained 611 mg Ag/$m^2$. The film, after treatment in the silver halide fixing solution, contained 13 mg Ag/$m^2$. The results indicated that 98 percent of the silver had been removed from the film. The final film had a hazy appearance.

The compounds in the following table can be used to obtain a stabilized image similar to that in Example 6:

TABLE

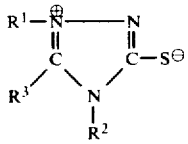

| Example | $R^1$ | $R^2$ | $R^3$ |
|---|---|---|---|
| 8 | $CH_3$ | $CH_2CH_2OCH_3$ | phenyl |
| 9 | i-propyl | $CH_3$ | $CH_3$ |
| 10 | $CH_3$ | i-propyl | $CH_3$ |
| 11 | dodecyl | $CH_3$ | $CH_3$ |
| 12 | $CH_3$ | phenyl | phenyl |
| 13 | 4-tolyl | $CH_3$ | $C_2H_5$ |
| 14 | $CH_3$ | phenyl | $CH_3$ |
| 15 | phenyl | pentyl | $CH_3$ |
| 16 | $CH_3$ | $C_2H_5$ | $CH_3$ |
| 17 | $CH_3$ | 4-methoxyphenyl | $CH_3$ |
| 18 | $CH_3$ | $CH_2CH(OCH_3)_2$ | $CH_3$ |
| 19 | $CH_3$ | $CH_3$ | i-propyl |
| 20 | $CH_3$ | $C_{18}H_{37}$ | $CH_3$ |
| 21 | $CH_3$ | $CH_3$ | $C_5H_{11}$ |
| 22 | $CH_3$ | $NH_2$ | $CH_3$ |
| 23 | $CH_3$ | $CH_2CH{=}CH_2$ | $CH_3$ |
| 24 | cyclohexyl | $CH_3$ | $CH_3$ |
| 25 | $CH_3$ | $NHC_6H_5$ | $C_9H_{19}$ |
| 26 | $CH_3$ | $N(C_2H_5)_2$ | $CH_3$ |
| 27 | $CH_3$ | $N(i\text{-}C_3H_7)_2$ | $CH_3$ |

The invention has been described in detail with particular reference to preferred embodiments thereof, but it will be understood that variations and modifications can be effected within the spirit and scope of the invention.

What is claimed is:

1. In a heat developable and heat stabilizable photographic silver halide element comprising a support having thereon, in reactive association, in binder:

(a) photographic silver halide, (b) a photographic silver halide developing agent, (c) an activating concentration of a thermal base releasing compound, the improvement comprising (d) a stabilizing concentration of a mesoionic 1,2,4-triazolium-3-thiolate silver halide stabilizer.

2. A heat developable and heat stabilizable photographic silver halide element as in claim 1 wherein said mesoionic 1,2,4-triazolium-3-thiolate consists essentially of a compound represented by the formula:

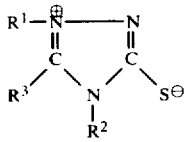

wherein $R^1$ is alkyl containing 1 to 18 carbon atoms, aryl containing 6 to 20 carbon atoms, or cycloalkyl containing 3 to 12 carbon atoms;

$R^2$ is amino, alkenyl containing 3 to 18 carbon atoms, alkyl containing 1 to 18 carbon atoms, aryl containing 6 to 20 carbon atoms, cycloalkyl containing 3 to 12 carbon atoms, or alkoxyalkyl containing 2 to 18 carbon atoms; and $R^3$ is alkyl containing 1 to 9 carbon atoms or aryl containing 6 to 12 carbon atoms.

3. A heat developable and heat stabilizable photographic silver halide element as in claim 1 wherein said mesoionic 1,2,4-triazolium-3-thiolate consists essentially of 1,4,5-trimethyl-1,2,4-triazolium-3-thiolate.

4. A heat developable and heat stabilizable photographic silver halide element as in claim 1 wherein said binder consists essentially of gelatin.

5. A heat developable and heat stabilizable photographic silver halide element comprising a support having thereon, in reactive association, in a gelatino binder:

(a) photographic silver bromide;

(b) a photographic silver bromide developing agent;

(c) an activating concentration of a thermal base releasing compound consisting essentially of an ethylene bis(sulfonyl acetic acid) compound; and (d) a stabilizing concentration of a 1,2,4-triazolium-3-thiolate stabilizer precursor consisting essentially of 1,4,5-trimethyl-1,2,4-triazolium-3-thiolate.

6. In a heat developable and heat stabilizable photographic silver halide composition comprising (a) photographic silver halide, (b) a photographic silver halide developing agent, (c) an activating concentration of a thermal base releasing compound, the improvement comprising (d) a stabilizing concentration of a mesoionic 1,2,4-triazolium-3-thiolate silver halide stabilizer.

7. A heat developable and heat stabilizable photographic silver halide composition as in claim 6 wherein said mesoionic 1,2,4-triazolium-3-thiolate consists essentially of a compound represented by the formula:

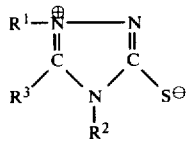

wherein $R^1$ is alkyl containing 1 to 18 carbon atoms, aryl containing 6 to 20 carbon atoms, or cycloalkyl containing 3 to 12 carbon atoms;

$R^2$ is amino, alkenyl containing 3 to 18 carbon atoms, alkyl containing 1 to 18 carbon atoms, aryl containing 6 to 20 carbon atoms, cycloalkyl containing 3 to 12 carbon atoms, or alkoxyalkyl containing 2 to 18 carbon atoms; and $R^3$ is alkyl containing 1 to 9 carbon atoms or aryl containing 6 to 12 carbon atoms.

8. A heat developable and heat stabilizable photographic silver halide composition as in claim 6 wherein said mesoionic 1,2,4-triazolium-3-thiolate consists essentially of 1,4,5-trimethyl-1,2,4-triazolium-3-thiolate.

9. A heat developable and heat stabilizable photographic silver halide composition as in claim 6 also comprising a binder.

10. A heat developable and heat stabilizable photographic silver halide composition as in claim 6 also comprising a gelatino binder.

11. A heat developable and heat stabilizable photographic silver halide composition comprising, in a gelatino binder:

(a) photographic silver bromide;

(b) a photographic silver bromide developing agent;

(c) an activating concentration of a thermal base releasing compound consisting essentially of an ethylene bis(sulfonyl acetic acid) compound; and (d) a stabilizing concentration of a silver halide stabilizer consisting essentially of 1,4,5-trimethyl-1,2,4-triazolium-3-thiolate.

12. A process of developing and stabilizing an image in an exposed photographic element as defined in claim 1 comprising heating said element to a temperature within the range of about 100° C. to about 180° C. until said image is developed and stabilized.

13. A process of developing and stabilizing an image in an exposed photographic silver halide element comprising a support having thereon, in a gelatino binder:

(a) photographic silver halide;

(b) a photographic silver halide developing agent;

(c) an activating concentration of a thermal base releasing compound, and (d) a stabilizing concentration of a silver halide stabilizer consisting essentially of 1,4,5-trimethyl-1,2,4-triazolium-3-thiolate, said process comprising heating said element to a temperature within the range of about 120° C. to about 180° C. until said image is developed and stabilized.

14. A photographic silver halide fixing composition comprising a silver halide fixing concentration of a mesoionic 1,2,4-triazolium-3-thiolate and an organic acid.

15. A photographic silver halide fixing solution comprising, in an aqueous solvent, a fixing concentration of a mesoionic 1,2,4-triazolium-3-thiolate and acetic acid.

16. A photographic silver halide fixing composition comprising a silver halide fixing concentration of 1,4,5-trimethyl-1,2,4-triazolium-3-thiolate and acetic acid.

17. A photographic silver halide fixing solution comprising, in an aqueous solvent, a silver halide fixing concentration of 1,4,5-trimethyl-1,2,4-triazolium-3-thiolate and acetic acid.

* * * * *